US008998740B2

(12) United States Patent
Corcoran et al.

(10) Patent No.: US 8,998,740 B2
(45) Date of Patent: Apr. 7, 2015

(54) COLLAPSIBLE AIR RESISTANCE TRAINING TOOL FOR IMPROVED SWING

(71) Applicants: Jerry Alvin Corcoran, Canby, OR (US); Steven Warren Skinner, Canby, OR (US); Gregory Brian Freuler, Portland, OR (US)

(72) Inventors: Jerry Alvin Corcoran, Canby, OR (US); Steven Warren Skinner, Canby, OR (US); Gregory Brian Freuler, Portland, OR (US)

( * ) Notice: Subject to any disclaimer, the term of this patent is extended or adjusted under 35 U.S.C. 154(b) by 190 days.

(21) Appl. No.: 13/910,381

(22) Filed: Jun. 5, 2013

(65) Prior Publication Data

US 2014/0364247 A1 Dec. 11, 2014

(51) Int. Cl.
*A63B 69/36* (2006.01)
*A63B 21/008* (2006.01)

(52) U.S. Cl.
CPC ..... *A63B 21/0088* (2013.01)

(58) Field of Classification Search
USPC ..... 473/219, 223, 226, 228, 257, 422, 437, 473/451, 457
See application file for complete search history.

(56) References Cited

U.S. PATENT DOCUMENTS

| | | | | |
|---|---|---|---|---|
| 5,207,625 | A * | 5/1993 | White | 482/111 |
| 5,803,838 | A * | 9/1998 | DeMarini et al. | 473/437 |
| 7,458,900 | B1 * | 12/2008 | Park | 473/228 |
| 2003/0207719 | A1 * | 11/2003 | Hughes | 473/228 |
| 2005/0215339 | A1 * | 9/2005 | Namba | 473/228 |
| 2007/0293334 | A1 * | 12/2007 | Osborne | 473/228 |

* cited by examiner

*Primary Examiner* — Nini Legesse
(74) *Attorney, Agent, or Firm* — Mark S. Hubert

(57) ABSTRACT

A collapsible golf swing training tool employs a plurality of elliptical blades, attached to a weighted shaft, to capitalize on air resistance, to aid in developing the muscle memory and strength required for a smooth and consistent golf swing. Cylindrical weights can be added or removed to meets the user's needs and may be positioned such that their linear axis is parallel or perpendicular to the linear axis of the tool. For convenience the blades are collapsible for easy storage within a golfer's golf bag.

10 Claims, 6 Drawing Sheets

COLLAPSIBLE AIR RESISTANCE TRAINING TOOL FOR IMPROVED SWING

BACKGROUND

Paramount to a good golf game is developing and maintaining a good golf swing. The swing should be completed in one smooth, fluid motion. This is not easily accomplished. Many golfers have quick, jerky movements or take the backswing up too quickly, resulting in a loss of control of the direction of the ball as well as a loss in distance. In an attempt to correct these bad habits, golf instructors will advise their students to slow down their backswing and mindfully focus on creating a fluid movement from the backswing to the downswing and finally the follow through. Unfortunately, it is simply hard for people to "feel" their own swing and develop the muscle memory needed to consistently produce a smooth swing.

SUMMARY OF THE INVENTION

The air resistance training tool for improved golf swing of the present invention has a plurality of extendable elliptical shaped blades radially disposed around the tool shaft. At the proximate end of the tool shaft is a handgrip similar to a conventional golf club grip and at the distal end are removable and stackable cylindrical weights. When a user practices his swing the elliptical blades catch the air and provide the user with immediate biofeedback as to the path of his/her swing. The user can now "feel" the lag" in his/her swing, and can determine if there are "casting" or not. Should the user's movements be jerky, the user experiences a pronounced jerky feel (in comparison to practicing with a golf club), since the surface area of the blades is catching more air. Now that the user can "feel" his/her swing, he/she can take corrective actions to minimize the blade generated turbulent flow. The air resistance training tool of the present invention also allows the user to add weight to the distal end of the tool shaft not only allowing the user to develop the muscles used to swing a golf club, but also shortening the time required for the muscles to learn the proper swing. An equatorial band affixed to the approximate midpoint of each blade further stabilizes the extended or deployed position of the elliptical blades. The blades are collapsible via a sliding mechanism, making the air resistance training tool for improved golf swing easily storable in one's golf bag.

DETAILED DESCRIPTION

Figure 1:
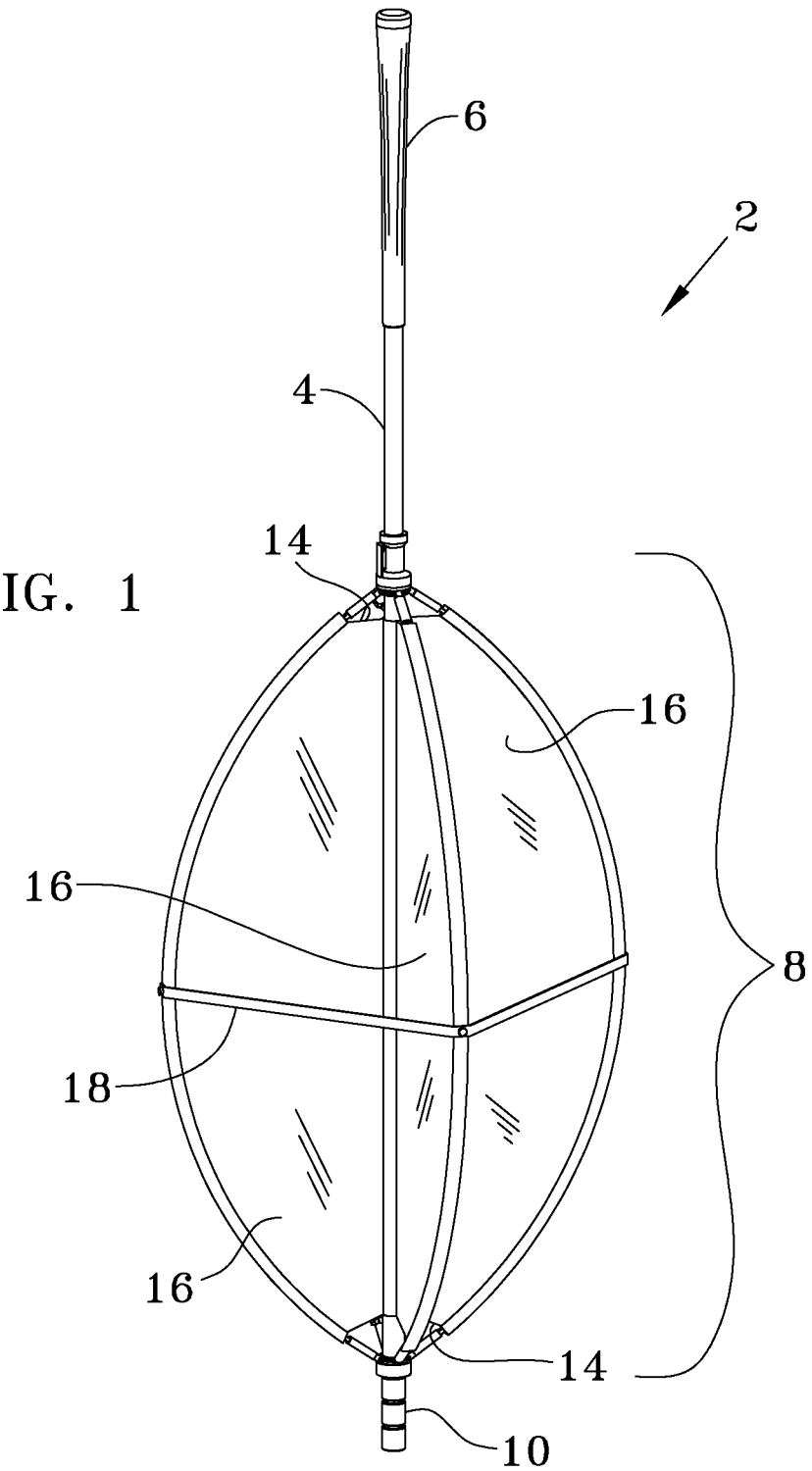
FIG. 1 is a perspective view of the golf swing training tool in an extended configuration.
Figure 2:
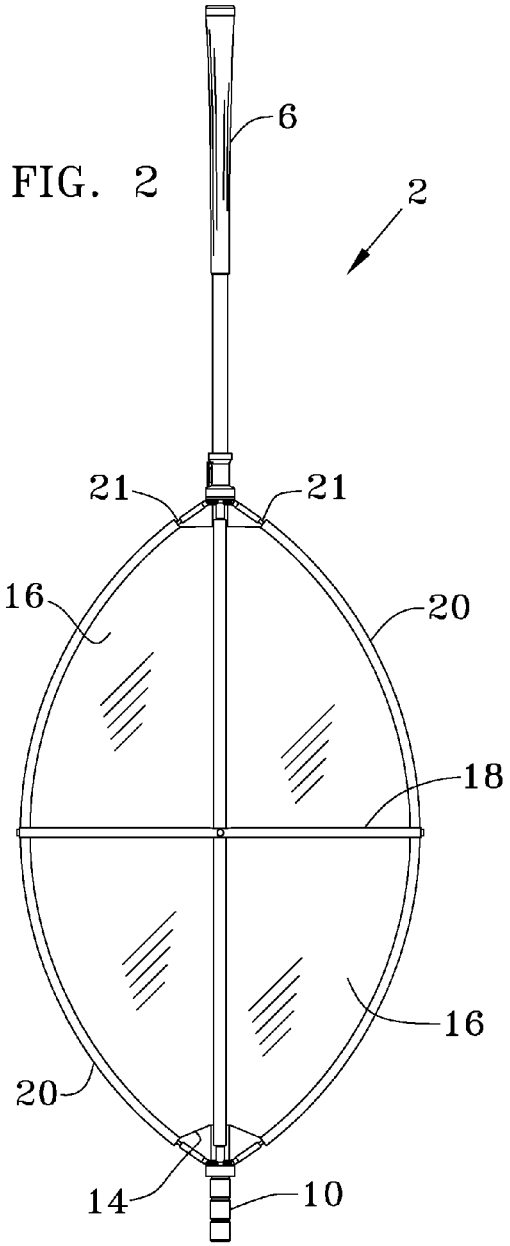
FIG. 2 is a left-side view of the golf swing training tool in an extended configuration.
Figure 3:
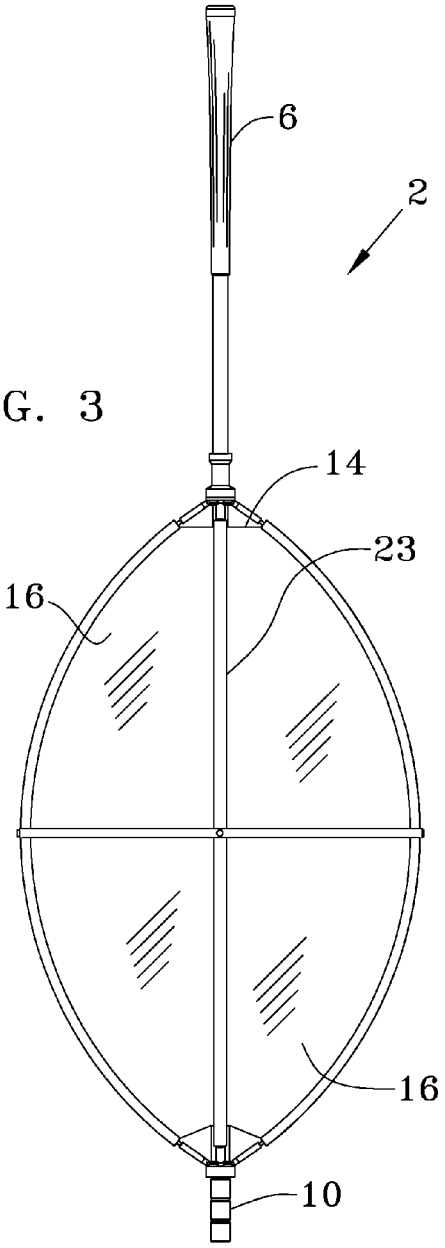
FIG. 3 is a back view of the golf swing training tool in an extended configuration.

The air resistance training tool 2 for improved swing of the exemplary embodiment is illustrated in FIGS. 1-3 and generally comprises a shaft 4, grip 6, blade portion 8, and weights 10. Shaft 4 and grip 6 are generally designed to mimic the look and feel of a golf club. There are interchangeable grips, a golf grip and a training grip. These grips are well known in the industry and differ only in the depth of the finger grooves. Blade portion 8 includes blade ribs 12 (visible in FIGS. 6, 9-10), a blade canopy 14, and an equatorial band 18.

Figure 6:
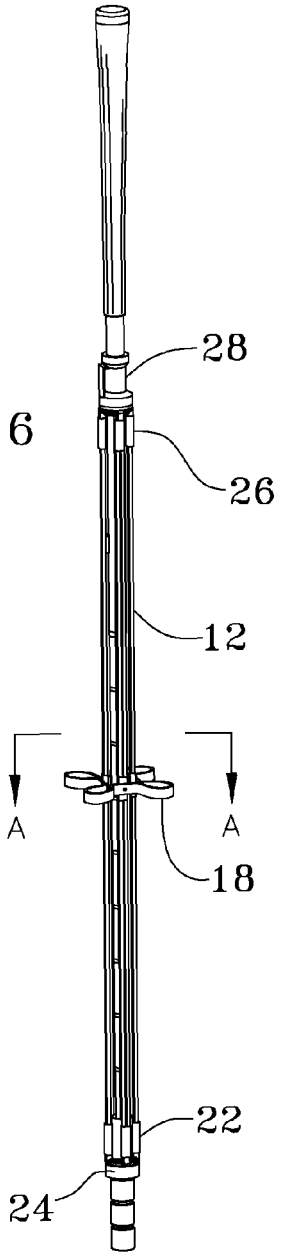
FIG. 6 is a perspective view of the golf swing training tool in a collapsed configuration with the fabric webbing removed for visual clarity.
Figure 7:
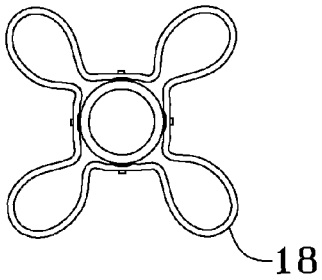
FIG. 7 is a top view of the golf swing training tool in a collapsed configuration with the fabric webbing removed for visual clarity.
Figure 8:
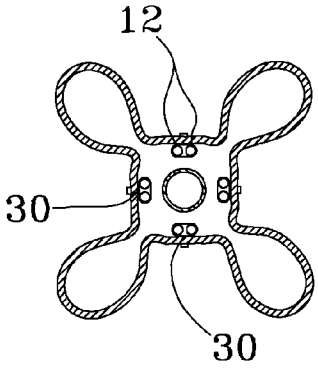
FIG. 8 is a cross-sectional view taken an A-A on FIG. 6 of the golf swing training tool in a collapsed configuration with the fabric webbing removed for visual clarity.
Figure 9:
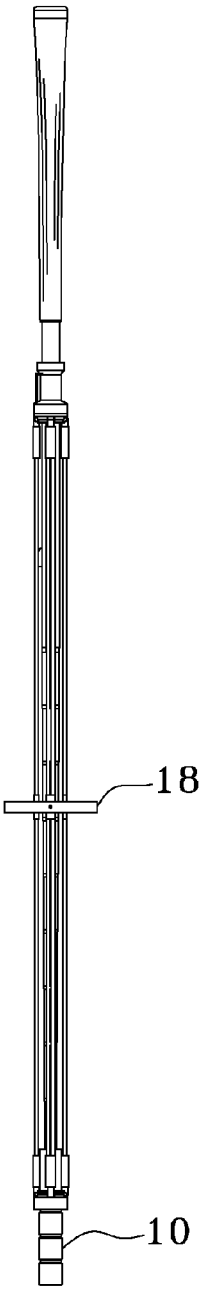
FIG. 9 is a left-side view of the golf swing training tool in a collapsed configuration with the fabric webbing removed for visual clarity.
Figure 10:
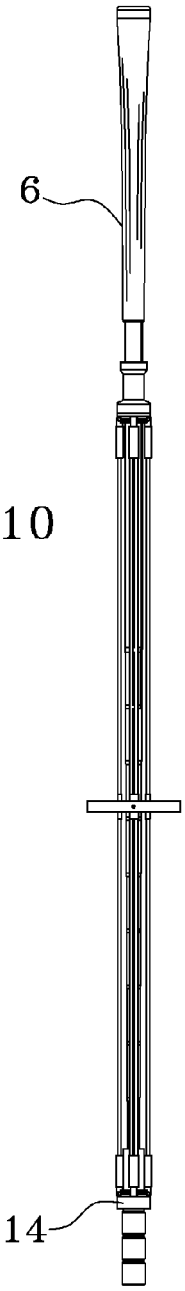
FIG. 10 is a back view of the of the golf swing training tool in a collapsed configuration with the fabric webbing removed for visual clarity.

In FIG. 6, 9-10 blade canopy 14 has been removed for visual clarity. The cross-section shown in FIG. 8 illustrates how eight blade ribs 12 are grouped together in pairs to form the four distinct blades 16 of tool 2. Blade ribs 12 are made of fiberglass for durability and flexibility, but could be made from any suitable material such as a durable, flexible polymer. It has been found that pairing blade ribs 12 to form one blade backbone 20 (see FIG. 8) provides a unique combination of strength and flexibility, while keeping the blade diameter reduced; thus, a thinner profile when compacted. It also accommodates the attachment of the coupler 30. The dual rib 12 construction of backbone 20 also allows for the failure of a singe blade without compromising the entire tool 2. In order to form blade backbone 20, two blade ribs 12 are secured together via stop sheath 22 at the distal end of tool 2 and stop sheath 22 is hingedly coupled to rib stop 24, and at the proximate end of tool 2, blade ribs 12 are secured via slide sheath 26, which is in turn hingedly or pivotally coupled to slider 28. Rib stop 24 as illustrated is comprised of a cylindrical body affixed about shaft 4 and is made from a durable polymer. Rib stop 24 is further comprised of a circular, metal ring affixed about its perimeter to which stop sheaths 22 are hingedly coupled, allowing stop sheaths 22 to pivot about the metal ring as slider 28 is moved along shaft 4, towards rib stop 24, so as to compress and deform the blade backbone in a semi elliptical configuration. (As the slider 28 is moved along shaft 4 away from rib stop 24 so as to uncompress the blade backbone 20, the stop sheaths also pivot about the metal ring as the blade backbone returns to its uncompressed linear configuration.) Slider 28 is also comprised of a cylindrical body formed about shaft 4 to allow sliding movement along shaft 4. Slider 28 is further comprised of a metal ring about its perimeter to which slide sheaths 26 are handedly coupled. Slider 28 slides along shaft 4 to deploy or collapse blade backbones 20 and draw taut blade canopy 14 by compressing or decompressing blade backbones 20 about their proximate end which is fixed by the rigid attachment of the rib stop 24 to the proximate end of the shaft 4. Shaft 4 additionally comprises a slider lock (not illustrated) for releasably fixing slider 28 for maintaining a deployed or compressed state of the blade portion 8. The slider lock could be a simple retractable fin that is spring loaded within shaft 4, such that the retracted fin can reside both inside and outside shaft 4, as is well known in the art. As slider 28 passes over the retractable fin, the fin moves into shaft 4 allowing slider 28 to pass over the fin. Once slider 28 has moved over the fin, the fin returns to its default position outside of shaft 4 preventing the movement of the slider 28 toward the distal end of the shaft 4. To fix slider 28 in a deployed state with the blade backbone compressed, slider 28 further comprises an orifice to allow the fin to reside outside shaft 4 but inside slider 28, blocking movement of slider 28 along shaft 4. To return tool 2 to its collapsed or storing (non-compressed) position the user can push inward (towards shaft 4) on the fin, while moving slider 28 towards the proximate end of tool 2. The fin will move inside shaft 4, until slider 28 has passed over it. In an alternate embodiment (not illustrated) the slider lock may be constructed with a spring-loaded projection that extends normally from the shaft 4 under spring pressure and fits into a matingly conformed detent formed in the slider 28 as is well known in the art. In an alternate embodiment the slider lock could be a flexible first tooth employed on the slider 28 that would engage on a matingly conformed second tooth on the shaft 4. The flexibility of the first tooth would allow it to be elastically deformed about its midpoint upon the application of finger force so as to disengage and engage the teeth to lock the tool 2 into its open configuration. This type of design would prevent the twisting engagement of the slider 28 thereby maintaining the blades when taut, in a planar configuration.

In addition to being coupled at the proximate and distal ends of tool 2, blade ribs 12 of each backbone 20 are coupled together about their approximate midpoint via equatorial strap coupler 30 as shown in FIGS. 6 and 8. In the illustrated embodiment equatorial strap coupler 30 is a cylindrical sheath with an elliptical cross section, allowing two ribs to reside side-by-side within coupler 30, while providing a relatively flat surface for riveting said equatorial strap 18 thereto, as is illustrated in FIG. 8.

To move blade portion 8 from a collapsed state to a deployed (or compressed) state, the user simply moves slider 28 along shaft 4 towards rib stop 24 located at the distal end of tool 2. As slider moves towards rib stop 24, a compressive force is exerted upon the then linear blade backbones 20, forcing them to deform away from the linear axis of the shaft 4 so as to form a semi elliptical configuration that extends normally from said shaft 4. As this happens, slide sheaths 26 are forced to pivot about the metal ring of slider 28, away (out) from shaft 4 simultaneously with the stop sheaths 22 pivoting about the metal ring of the rib stop 24, also away (out) from shaft 4. This continues until the blade backbones 20 form a semi elliptical configuration about the linear axis of the shaft 4 and the blade canopy 14 is drawn taut.

Figure 4:
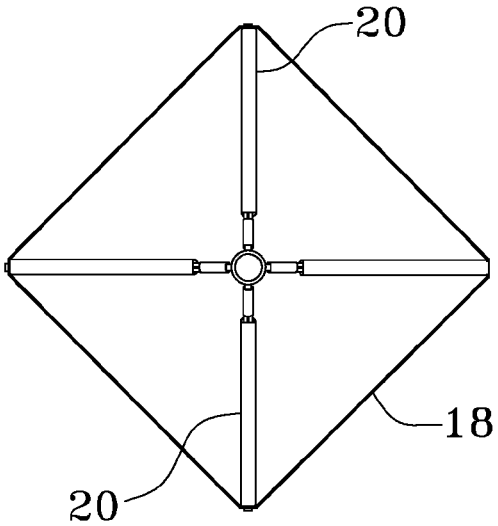
FIG. 4 is a top view of the golf swing training tool in an extended configuration.
Figure 5:
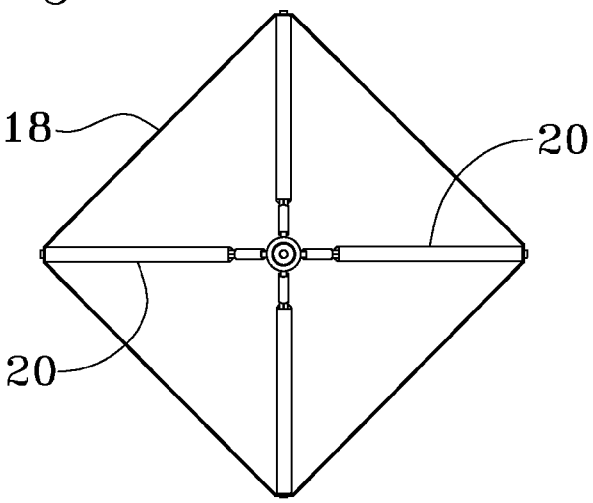
FIG. 5 is a bottom view of the golf swing training tool in an extended configuration.

Equatorial band 18 is designed to fit tautly around each backbone 20 of blades 16 as illustrated in FIGS. 4-5, when blade portion 8 is in its deployed or extended configuration and the blade canopy 14 is taut , in its fully extended position. Equatorial strap 18 provides lateral support to all blades 16, minimizing movement of the blades 16 during swing practice with tool 2. Minimizing the movement of blades 16 creates more air-resistance, adding stress to the muscles used to swing tool 2, and hence strengthening the swing muscles. Additionally, the biofeedback the user feels is maximized; the user simply "feels" the torque resulting from a jerky swing of tool 2, the "lag: effect as well as the "casting" effect. Equatorial strap 18 can be made of any pliable, yet durable material such as nylon rope. When the tool 2 is fully deployed and the blade canopy 14 fully extended and taut, the equatorial strap 18 is a circular continuous band of fabric that is also taut.

Blade canopy 14 can be constructed of any lightweight, wind proof, durable fabric such as nylon. Blade canopy 14 is designed to fit over all blade ribs 12 and is stitchedly affixed to itself along the longitudinal axis of shaft 4 to create four distinct blades 16, while also making a tubular or cylindrical pocket 23 within which shaft 4 resides, and allowing canopy 14 to slide up or down shaft 4 as the tool 2 is deployed or collapsed. Canopy 14 is also stitched along its outer peripheral edge or perimeter so as to create a backbone pocket 21, to house each backbone 20. The backbone pockets 21 do not extend fully over the blade backbones 20 between the blade backbones proximate and distil ends, but rather end short of the blade backbone 20 and rib stop/slider connections so as to allow the canopy 14 to slide over the flexing blade backbones 20 as the canopy slides up and down the shaft 4.

Figure 11:
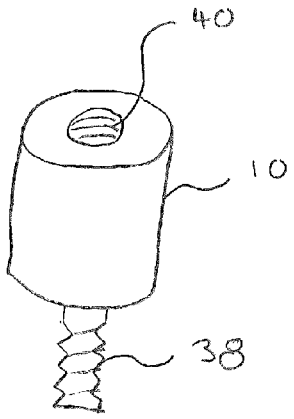
FIG. 11 is a side view of the weight system utilized.
Figure 12:
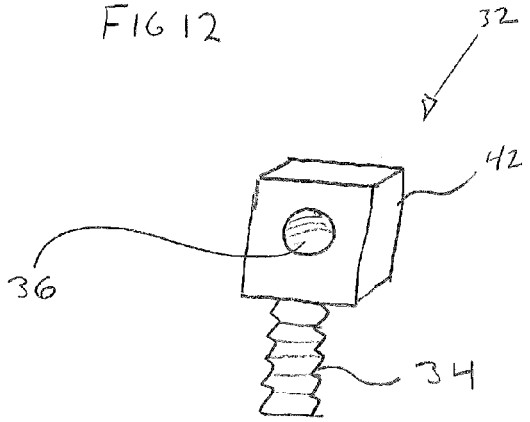
FIG. 12 is a side view of the perpendicular weight retention stud.

In assembly, the flexible fabric blade canopy's central cylindrical pocket 23 is fitted over the shaft 4 before the rib stop 24 and slider 28 are mounted onto to the shaft 4, and the blade backbones 20 are fitted through the backbone pocket 21 before connection to the slide sheaths 26 and stop sheaths 22. To increase the weight of tool 2, cylindrical weights 10 can be added at the distal end of shaft 4. Weights 10 allow the user to increase or decrease the weight of tool 2 thereby shortening or lengthening the time to increase his/her swing strength. The first weight 10 has a threaded boss 38 that threadingly engages a matingly conformed first recess (FIG. 11) formed on the distal end of shaft 4. Subsequent weights 10 have a threaded boss on one end and a matingly conformed second recess 40 formed therein the opposite end. In this way additional weights 10 may be connected by threaded engagement to increase the swing resistance. There is also an optional perpendicular weight retention stud 32 that has a body 42 threaded member 34 on one end and a threaded orifice 36 formed therein that lies perpendicular to the linear axis of the tool 2. This threaded orifice 36 is matingly conformed to accept the threaded boss 38 on the weights. In this way the weights can also be attached to the tool 2 in a perpendicular fashion. Used in this way, the tool can be used to promote the proper "club head release" when the linear axis of the perpendicular mounted weights on the tool 2 are aligned with the linear axis of the golfer's body. (FIG. 12)

To use the air resistance training tool of the present invention, the user simply practices his/her golf swing with tool 2 with blade section 8 in its deployed configuration. During swing practice the blades 16 will catch the air. Since blades 16 are immobile the user will immediately notice how his swing is slowed, and any non-fluid or jerky movement is magnified such as "casting". The increased "feel" of the user's swing allows him/her to focus on specific movements to decrease the drag of tool 2 and any torque generated by non-fluid movement, overcoming his/her bad form such as "casting", and it also helps to reinforce good form such as one with proper "lag", therein developing a smooth swing.

The thin profile provide by the collapsible feature of the tool 2 allows it to be compactly stored in a golf bag aside the clubs.

Although a specific embodiment has been illustrated and described herein, it will be appreciated by those of ordinary skill in the art that a wide variety of alternate and/or equivalent implementations calculated to achieve the same purposes may be substituted for the specific embodiment shown and described without departing from the scope of the present invention. Therefore, it is intended that this invention be limited only by the claims and the equivalents thereof.

We claim:

1. An air resistance training tool collapsible into thin profile tool adapted for transport in a golf bag, for the development of a better golf club swing comprising:

a linear shaft having a linear axis and a distal and proximate end;

a rib stop affixed at said proximate end of said linear shaft;

a grip affixed at said distal end of said linear shaft;

a slider residing about said linear shaft between said grip and said stop sheath, and capable of linear motion along said linear shaft;

a releaseable slider lock affixed to said shaft between said shaft's distal and proximate ends;

at least one flexible blade backbone having a first end and a second end and a longitudinal axis substantially parallel to said linear axis of said linear shaft when said backbone is in a non-compressed state;

a stop sheath pivotally affixing said first end of said blade backbone to said rib stop;

a slide sheath pivotally affixing said second end of said blade backbone to said slider;

a slider lock affixed on said shaft between said proximate and distal ends;

a flexible fabric blade canopy defining an open ended central cylinder with at least one generally semi elliptical fabric blade extending radially therefrom, said fabric blade having an open ended cylindrical pocket extending along a peripheral edge thereof;

wherein said blade canopy central cylinder is fitted over said linear shaft and said fabric blade cylindrical pocket is fitted over said blade backbone; and wherein said blade backbone is affixed at said first end to said stop sheath and affixed at said second end to said slide sheath such that when said slider is moved to an open position along said shaft, said blade backbone deforms to form an arc between said slider and said stop sheath, drawing taut said fabric blades such that they reside perpendicular to said linear axis of said shaft.

2. The air resistance training tool of claim 1 wherein the number of blade backbones, and fabric blades is four, and each of said longitudinal axes of said blade backbones reside adjacent and parallel to said linear axis of said shaft when in their non-compressed state, oriented generally radially equidistant about said shaft.

3. The air resistance training tool of claim 2 wherein each said blade backbone is comprised of a set of at least two flexible linear blade ribs, each set of blade ribs connected together about their approximate center by an equatorial strap coupler.

4. The air resistance training tool of claim 3 further comprising a flexible equatorial strap that is affixed to each of said equatorial cord couplers so as to form a circle when all said blade backbones are in a fully compressed and deformed state.

5. The air resistance training tool of claim 4 where said slide sheath lock is a spring loaded member that extends normally from said shaft, perpendicular to said linear axis of said shaft and retains said slide sheath in a position between said proximate and distal end of said shaft when said blade backbones are in a compressed, deformed state.

6. The air resistance training tool of claim 5 further comprising a series of weights removably affixed at said proximate end of said shaft.

7. The air resistance training tool of claim 6 further comprising a perpendicular weight retention stud having a body with a threaded stud extending therefrom, and an threaded orifice formed therethrough that has a first linear axis that lies perpendicular to a second linear axis of said threaded stud, and wherein said weights have a threaded boss extending normally from a bottom thereof and a matingly conforming first recess extending normally from a top thereof, and where said rib stop end has a second recess extending normally therein that matingly conforms to said threaded stud for engagement such that said perpendicular weight retention stud may be threadingly affixed to said rib stop end and said threaded boss of said weight may be threadingly engaged with said threaded orifice or threadingly engaged with said threaded orifice.

8. The air resistance training tool of claim 6 wherein said weights are cylindrical in configuration with a threaded boss extending normally from a circular bottom thereof said weights and a matingly conforming first recess extending normally from a circular top thereof said weights, and where said rib stop end has a second recess extending normally therein that matingly conforms to said threaded boss for engagement.

9. The air resistance training tool of claim 8 wherein said equatorial strap coupler is a cylindrical sheath with an elliptical cross section, allowing two ribs to reside side-by-side within coupler while providing a relatively flat surface for affixing said equatorial strap thereto.

10. The air resistance training tool of claim 8 further comprising:

a rib stop ring affixed to said rib stop and connecting said rib stop to said stop sheath;

and a slide sheath ring affixed to said slider and connecting said slider to said slide sheath.

* * * * *